United States Patent [19]

Zentmyer

[11] 4,109,912

[45] Aug. 29, 1978

[54] NIGHT STICK STRUCTURE

[76] Inventor: John Hobart Zentmyer, 124-F N. Brighton St., Burbank, Calif. 91506

[21] Appl. No.: 778,393

[22] Filed: Mar. 17, 1977

[51] Int. Cl.[2] ..... F41B 15/02

[52] U.S. Cl. ..... 273/84 R; 156/85;

[58] Field of Search ..... 273/67 R, 73 J, 75, 273/81 R, 81 C, 81 D, 81.3, 82 R, 84 R, 162 R, 193 R; 156/85, 86, 289; 46/47, 51 84/477 B

[56] References Cited

U.S. PATENT DOCUMENTS

| | | | |
|---|---|---|---|
| 1,920,169 | 8/1933 | Briggs | 273/81.3 X |
| 2,225,839 | 12/1940 | Moore | 273/81 C |
| 3,373,068 | 3/1968 | Grosheim et al. | 156/289 X |
| 3,616,566 | 11/1971 | Simpson et al. | 46/151 |
| 3,637,205 | 1/1972 | Bankston | 273/84 R X |
| 3,804,413 | 4/1974 | Hrivnak | 273/81 C |
| 3,962,949 | 6/1976 | Trowbridge | 84/477 B |
| 4,027,879 | 6/1977 | Wright | 273/29 A |

OTHER PUBLICATIONS

"Black Belt", July, 1969, p. 14.

*Primary Examiner*—Richard J. Apley
*Attorney, Agent, or Firm*—Harry R. Lubcke

[57] ABSTRACT

The addition of a dual-acting sleeve enhances the capabilities of a police night stick, or baton, that has a right-angled auxiliary handle. By exercising light hand-grasp pressure on the sleeve the baton can be maneuvered rotatively about the auxiliary handle. By exercising a firm pressure on the sleeve the rotation can be instantly stopped.

10 Claims, 4 Drawing Figures

NIGHT STICK STRUCTURE

BACKGROUND OF THE INVENTION

For many years the standard straight cylindrical police baton has been an effective tool in the hands of a police officer. This has been the 3.4 centimeter (cm) diameter by 60 cm long model weighing somewhat less than a kilogram.

Recently, an improvement in the basic structure has been evolved; in that an auxiliary right-angle handle, also known as the "Yawara" handle, has been added at one-fourth the distance from one end of the baton.

This additional handle allows new maneuvers that could not be performed with the straight baton. Among these is the ability to grasp the auxiliary handle and rapidly swivel the baton back and forth to ward off potential attackers.

The problem that arises; however, is that after two or three such swings gravity pulls the baton down through the user's hand, making further such motion impossible. The user must then stop and reposition the baton before continuing, leaving open the possibility of attack.

A modified construction that would eliminate this undesirable feature and improve the effectiveness of the baton would therefore be a significant advantage.

SUMMARY OF THE INVENTION

The modified construction embraces a sleeve of slightly deformable material that surrounds the right-angle auxiliary handle.

An unlimited number of rapid swivel motions and related maneuvers are then possible.

The user grasps the sleeve surrounding the auxiliary handle but with a light pressure exerted by his hand. The allowable pressure is conveniently sufficient to execute the maneuvers. The auxiliary handle rotates freely inside of the sleeve.

However, this motion can be immediately stopped by the user firmly grasping the sleeve.

DESCRIPTION OF THE PREFERRED EMBODIMENTS

Figure 1:
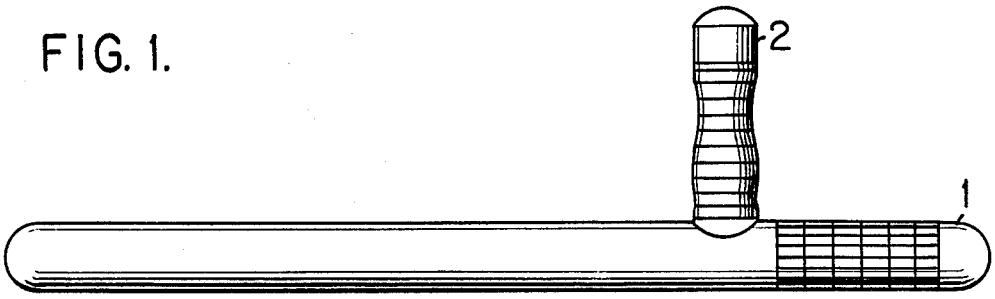
FIG. 1 shows the standard police baton having in addition the right angle auxiliary (Yawara) handle.

In FIG. 1 numeral 1 indicates the known straight cylindrical police baton. An auxiliary handle 2 is fixedly attached thereto at right-angles and about one-fourth the length of baton 1 from one end of it.

Figure 2:
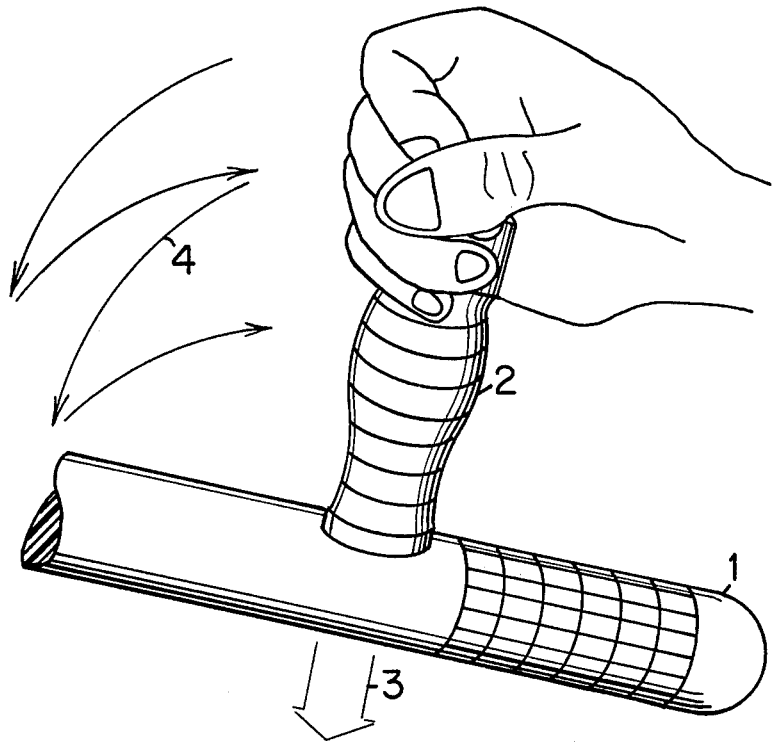
FIG. 2. PRIOR ART
FIG. 2 shows the undesired termination of the above baton after use of a few swivels back and forth by the user.

FIG. 2 shows the undesired termination of the desired swivel motion about auxiliary handle 2. The downward pull of gravity 3 causes the baton to to slip part way out of the hand of the user, as is represented by back-and-forth arrows 4, with each excursion of the swivel motion. This effect is brought about by the relatively long unbalanced cantilever beam aspect of the cylindrical baton 1 shaft, as seen in FIG. 1.

After this configuration exists the user must stop the maneuver and regrasp the auxiliary handle 2 over its entire length, thus being vunerable to attack during that interval.

Figure 3:
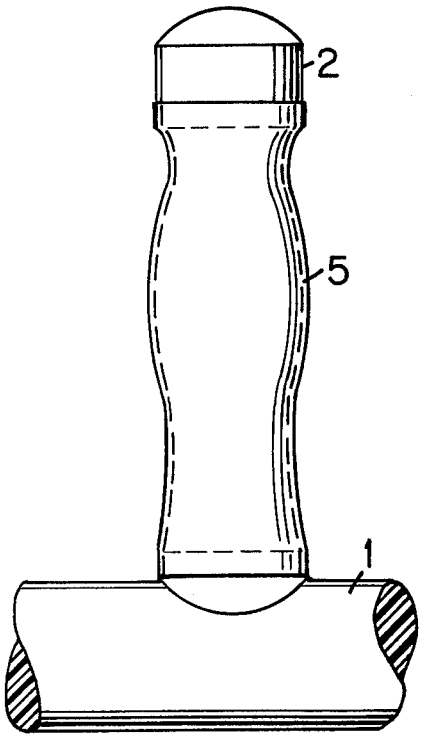
FIG. 3 shows the complete structure according to the invention.
Figure 4:
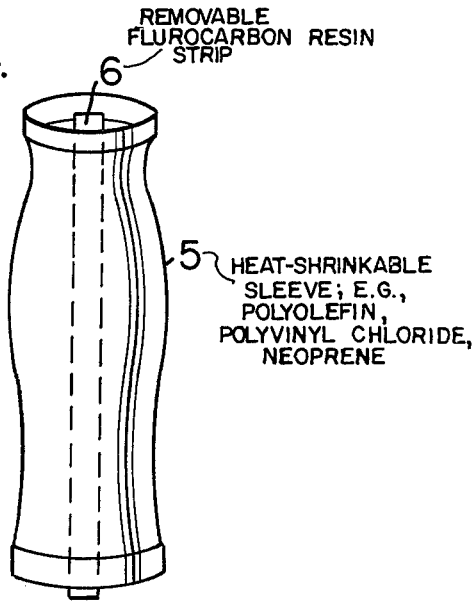
FIG. 4 shows a formed sleeve alone, in perspective.

In FIGS. 3 and 4 numeral 5 identifies the sleeve according to this invention. In situ it surrounds auxiliary handle 2. It preferably consists of a pre-cut piece of heat-formable tubing having a wall thickness of the order of 1 millimeter (mm).

The sleeve is fitted on handle 2 with a small amount of play, so that rotation of the handle within the sleeve is easily possible, but also so that the sleeve does not become detatched from the handle.

Such a fit can be attained by interposing a strip 6 of material along the entire length of handle 2 underneath sleeve 5 before the latter is heat shrunk. This may be a fluorocarbon resin, polytetrafluoroethylene, available as "Teflon"; or a polyvinylidene fluoride, available as "Kynar". This strip is removed when the heat shrinking has been completed and then the sleeve will revolve when lightly grasped. The strip may also be of soft metal, or other heat-proof material. Further, two strips may be used, each about 1 cm wide by 1 mm thick.

The shrinking process is preferably accomplished by using a heat gun, which emits a blast of hot air of a temperature of at least 175° Celsius (Centigrade). The heat gun is moved around the periphery of the sleeve to heat it uniformly, until the desired degree of shrinking effect is visually observed.

The heat may also be applied from a propane torch such as has a special tip for shrinking, such as gives a soft yellow flame.

A torch, propane or otherwise, with a usual tip that gives the short blue flame may also be used by holding the torch reasonably far from the sleeve 5, such as 10 centimeters.

Equivalent infra-red lamps may also be used. A hot liquid may also be used.

In use, the baton is used for rotative maneuvers with respect to auxiliary handle 2 by grasping sleeve 5 lightly. Good control of the baton is, nevertheless, obtained. When the rotation is to be stopped, a firm pressure by the hand accomplishes this at once. Rotation of the baton in a vertical plane and other combat maneuvers can also be more effectively performed with this invention.

The material of the sleeve may be an irradiated polyolefin, an irradiated polyvinyl chloride (PVC), or an irradiated neoprene, such as used in the electronics industry for convering and insulating splices in wires, or for permanently binding a multiplicity of wires into a single cable.

I claim:

1. The method of making a baton having an auxiliary handle that includes the steps of;

(a) providing a baton having an elongated shaft and an upstanding auxiliary handle, (b) placing a sleeve over the auxiliary handle, (c) placing at least one strip between the sleeve and the auxiliary handle, (d) applying heat locally and relatively evenly to the sleeve until the sleeve is shrunk to approximately the size of the auxiliary handle plus the strip, and (e) removing the strip.

2. The method of making the baton of claim 1 in which;

(a) said strip is formed of the fluorocarbon resin polytetrafluoroethylene.

3. The method of making the baton of claim 1 in which;

(a) said strip is formed of polyvinylidene fluoride.

4. The method of making the baton of claim 1 in which;

(a) said strip is formed of soft metal.

5. A baton comprising;

(a) an elongated shaft, (b) an auxiliary handle fixedly attached at an angle to said shaft adjacent to one end of said shaft, (c) a flexible sleeve non-detachably surrounding said auxiliary handle in fixed axial relation thereto, said sleeve fitted to allow said auxiliary handle to revolve within said sleeve when a minimal external pressure is exerted upon said sleeve, and to prevent revolution of said auxiliary handle within said sleeve when an external pressure sensibly greater than said minimal pressure is exerted upon said sleeve.

6. The baton of claim 5, in which;

(a) said sleeve is fabricated of a heat-shrinkable material that is heat-shrunk over said auxiliary handle.

7. The baton of claim 6, in which;

(a) said sleeve is of the order of 1 millimeter thick.

8. The baton of claim 6, in which;

(a) said heat-shrinkable material is an irradiated polyolefin.

9. The baton of claim 6, in which;

(a) said heat-shrinkable material is an irradiated polyvinyl chloride.

10. The baton of claim 6, in which;

(a) said heat-shrinkable material is an irradiated neoprene.

* * * * *